US008157366B2

(12) United States Patent
Okubo

(10) Patent No.: US 8,157,366 B2
(45) Date of Patent: Apr. 17, 2012

(54) LIQUID EJECTING HEAD AND LIQUID EJECTING APPARATUS INCORPORATING THE SAME

(75) Inventor: Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 506 days.

(21) Appl. No.: 12/389,028

(22) Filed: Feb. 19, 2009

(65) Prior Publication Data

US 2009/0207216 A1 Aug. 20, 2009

(30) Foreign Application Priority Data

Feb. 20, 2008 (JP) ..... 2008-038384
Nov. 7, 2008 (JP) ..... 2008-286217

(51) Int. Cl.
*B41J 2/17* (2006.01)
*B41J 2/045* (2006.01)

(52) U.S. Cl. ..... 347/94; 347/71

(58) Field of Classification Search ..... 347/94
See application file for complete search history.

(56) References Cited

FOREIGN PATENT DOCUMENTS

| | | |
|---|---|---|
| JP | 2000-177119 | 6/2000 |
| JP | 2001-010065 | 1/2001 |
| JP | 2001-121690 | 5/2001 |
| JP | 2001-353871 | 12/2001 |
| JP | 2004-042559 | 2/2004 |
| JP | 2006-256006 | 9/2006 |
| JP | 2007-145014 | 6/2007 |

*Primary Examiner* — Matthew Luu
*Assistant Examiner* — Lisa M Solomon
(74) *Attorney, Agent, or Firm* — Workman Nydegger

(57) ABSTRACT

A liquid ejecting head includes: a reservoir provided along a direction, the reservoir including a first area and a second area of a width smaller than that of the first area in a direction perpendicular to the direction in which the pressure generating chambers are parallelly-arranged; and compliance member provided in an area corresponding to the reservoir. The compliance member includes a first compliance section formed at one of the upper and lower surface sides of the reservoir and a second compliance section formed at the other of the upper and lower surface sides of the reservoir. The first compliance section is formed at an area corresponding to both the first area and the second area of the reservoir, and the second compliance section is not formed in at least an area corresponding to a part of the first area.

8 Claims, 8 Drawing Sheets

LIQUID EJECTING HEAD AND LIQUID EJECTING APPARATUS INCORPORATING THE SAME

BACKGROUND

1. Technical Field

The present invention relates to a liquid ejecting head and a liquid ejecting apparatus incorporating the same. More particularly, the invention relates to an ink jet recording head that discharges ink as a liquid and an ink jet recording apparatus incorporating the same.

2. Related Art

A known ink jet recording head, as an example of a liquid ejecting head, includes an actuator unit, a nozzle plate and a flow channel unit. The actuator unit includes piezoelectric elements and pressure generating chambers. The nozzle plate communicates with the pressure generating chambers and includes nozzle orifices for discharging ink. The flow channel unit includes a reservoir-forming substrate in which a reservoir is formed as a common ink chamber for the pressure generating chambers (see JP-A-2004-042559, pages 6 to 8 and FIGS. 1 and 2, for example).

In such an ink jet recording head, pressure applied to the ink in a pressure generating chamber generates a pressure wave within a pressure generating chamber. The pressure wave propagates to the reservoir which is in communication with the pressure generating chambers. The pressure wave propagates to other pressure chambers via the reservoir, which may cause variation in ink jet characteristics including a droplet ejection rate.

To address this problem, an ink jet recording head has been proposed in which the pressure wave is attenuated within the reservoir so as to prevent further propagation to other pressure generating chambers. With this configuration, variation in ink jet characteristics including a droplet ejection rate is controlled (see JP-A-2007-145014, pages 10 to 12 and FIG. 4, for example). In particular, energy of the pressure wave is absorbed by a compliance section formed as a thinned portion at an area corresponding to the reservoir. The compliance section has a pressure fluctuation absorbing function (hereinafter, referred to as "compliance").

The reservoir includes an inflow port for introducing ink at a central area along a direction in which the pressure generating chambers are arranged in parallel. When seen in plan view, the width of the reservoir is constant in the central area and is reduced at both end areas along a direction perpendicular to the direction in which the pressure generating chambers are arranged in parallel.

In a reservoir having a constant width across the full length thereof, a flow rate of the ink introduced in the central area decreases while moving toward both end areas of the reservoir. This may cause air bubbles to become entrapped in both end areas. To address the entrapment, the reservoir has the above-described configuration.

There is also a problem of deficient compliance in the narrowed areas of the reservoir. The compliance section fails to provide a desired vibration control effect.

Although an ink jet recording head has been illustrated, such a problem also exists in liquid ejecting heads for ejecting liquids other than ink.

SUMMARY

The invention can be implemented in embodiments and aspects described below.

A first aspect of the invention is a liquid ejecting head, which includes: a plurality of parallelly-arranged pressure generating chambers each discharging a liquid through a nozzle orifice by pressure fluctuation; a plurality of pressure generating elements which each generate a pressure fluctuation in the corresponding pressure generating chamber; a reservoir provided along a direction in which the plurality of pressure generating chambers are parallelly-arranged for supplying a liquid to the pressure generating chambers, the reservoir including a first area and a second area of a width smaller than that of the first area in a direction perpendicular to the direction in which the pressure generating chambers are parallelly-arranged; and compliance member provided in an area corresponding to the reservoir for absorbing pressure fluctuation in the reservoir, wherein: the compliance member includes a first compliance section formed at one of the upper and lower surface sides of the reservoir and a second compliance section formed at the other of the upper and lower surface sides of the reservoir; and the first compliance section is formed at an area corresponding to both the first area and the second area of the reservoir, and the second compliance section is not formed in at least an area corresponding to a part of the first area.

Application Example 1

According to the first aspect of the invention, the deficient compliance in the narrowed area of the first compliance section corresponding to the narrowed second area of the reservoir is compensated for by the compliance of the second compliance section. Vibration due to the pressure wave propagated from the pressure generating chamber can therefore be controlled in the reservoir more effectively. Accordingly, an ink jet recording head in which variation in ink jet characteristics resulting from, for example, variation in a droplet ejection rate is controlled can be obtained.

Note that it suffices that the second compliance section is formed in an area corresponding at least to the second area, and may be formed in an area corresponding to the first area as well as the area corresponding to the second area. If the second compliance section is formed in the area corresponding to the first area, deficient compliance of the first compliance section in the area corresponding to the first area is complemented by the compliance of the second compliance section. Accordingly, even if the entire first compliance section is narrow, the deficient compliance is easily and effectively compensated for by the second compliance section. Thus, vibration due to the pressure wave propagated from the pressure generating chamber can be controlled in the reservoir more effectively.

Application Example 2

It is preferable that a width of a predetermined section in an area corresponding to the second area of the first compliance section be smaller than that of the predetermined section of the second compliance section.

In this case, the deficient compliance at the narrowed area of the first compliance section is sufficiently compensated for by the compliance of the wider second compliance section. Vibration due to the pressure wave propagated from the pressure generating chamber can therefore be controlled in the reservoir more effectively. Accordingly, an ink jet recording head in which variation in ink jet characteristics resulting from, for example, variation in a droplet ejection rate is controlled can be obtained.

Application Example 3

It is preferable that the width of the reservoir be larger than the width of the first compliance section at a corresponding area.

In this case, even if the width of the first compliance section is formed narrower than that of the reservoir, compliance sufficient for a compliance section is exhibited by the compliance of the second compliance section.

Application Example 4

It is preferable that the first compliance section and the second compliance section be formed so that the width $l_1^4$+ the width $l_2^4$ is constant when the width of the other compliance section is $l_1$ and the width of the one compliance section corresponds to the width $l_2$.

In this case, the width $l_2$ of one of the compliance sections is determined to compensate for the deficient compliance in accordance with the width $l_1$ of the other of the compliance sections. Accordingly, the compliance can be constant in the second area of the reservoir. Thus, the energy of the pressure wave is absorbed at a constant rate and vibration due to the pressure wave propagated from the pressure generating chamber can be controlled in the reservoir more effectively.

Here, the term "constant" is not strictly defined and thus allows slight errors.

Application Example 5

A second aspect of the invention is a liquid ejecting apparatus which includes the liquid ejecting head described above.

According to the second aspect of the invention, the ink jet characteristics are improved and uniformized to provide a liquid ejecting apparatus with improved print quality.

DESCRIPTION OF EXEMPLARY EMBODIMENTS

Figure 1:
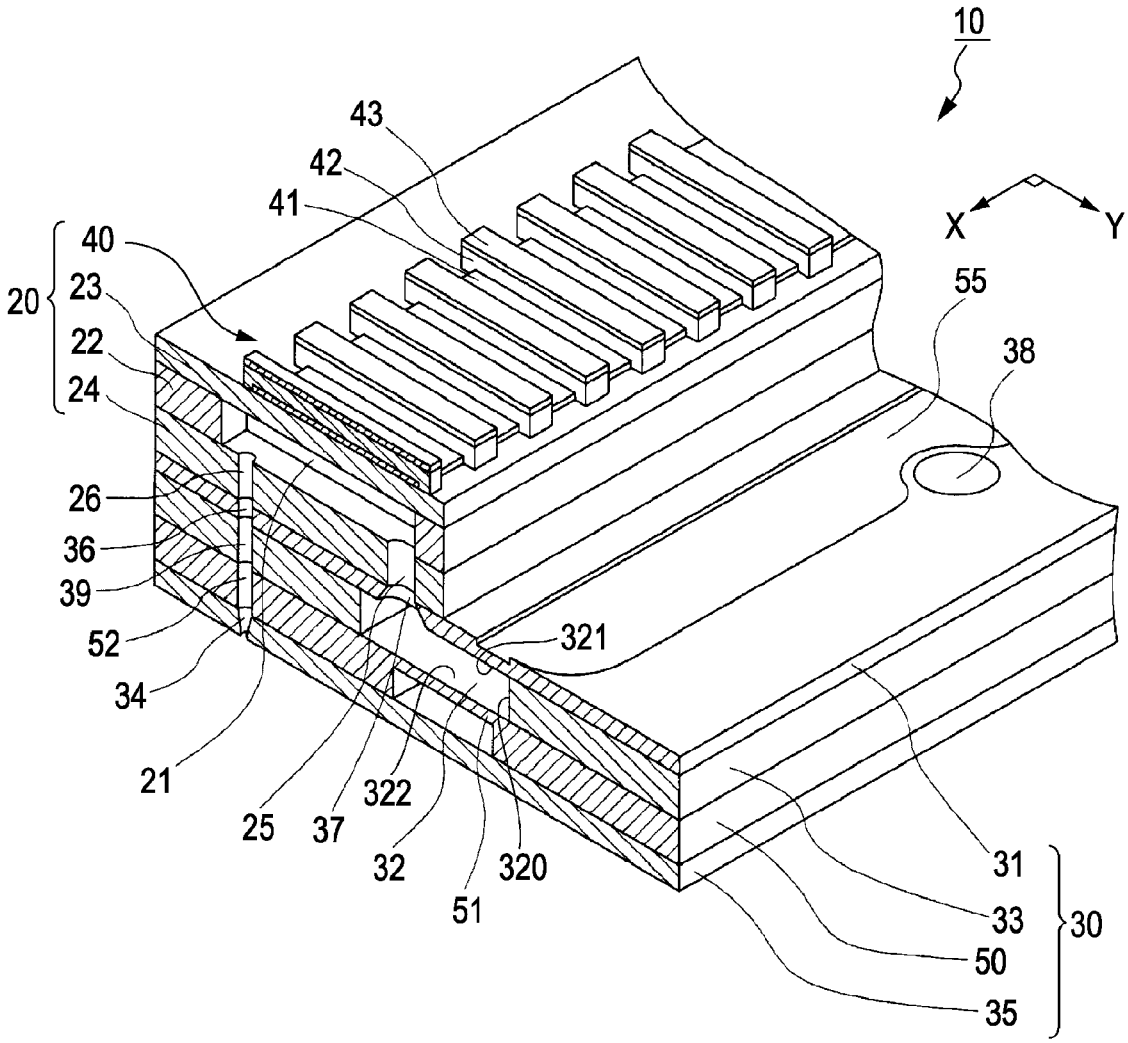
FIG. 1 is a perspective view showing an ink jet recording head according to a first embodiment of the invention partly cut away to illustrate a main part.

Referring now to the drawings, embodiments of the invention will be described in detail.

First Embodiment

FIG. 1 is a perspective view showing an ink jet recording head 10 as a liquid ejecting head according to a first embodiment of the invention partly cut away to illustrate a main part.

Figure 2:
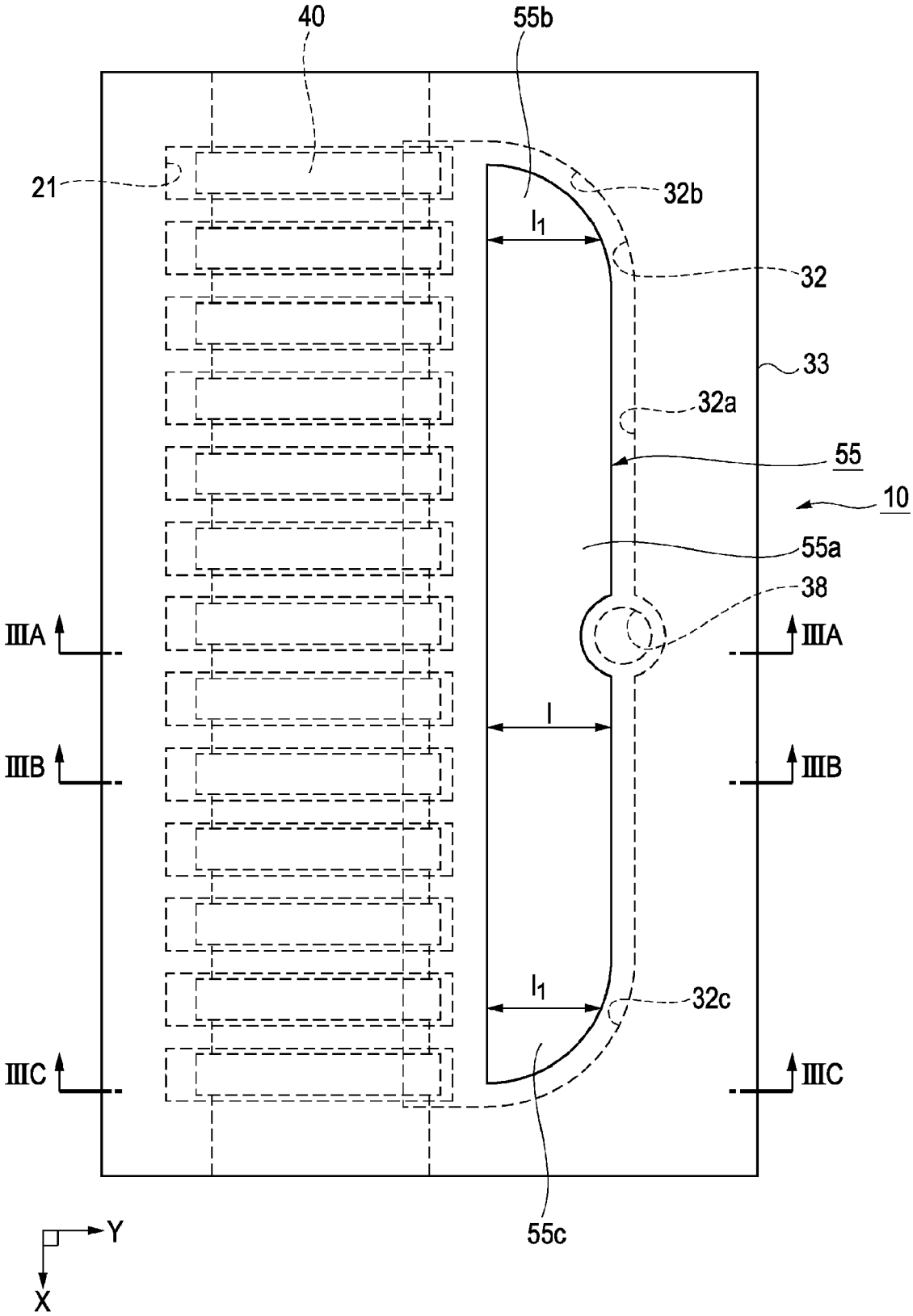
FIG. 2 is a plan view showing a main part of the ink jet recording head.
Figure 3A:
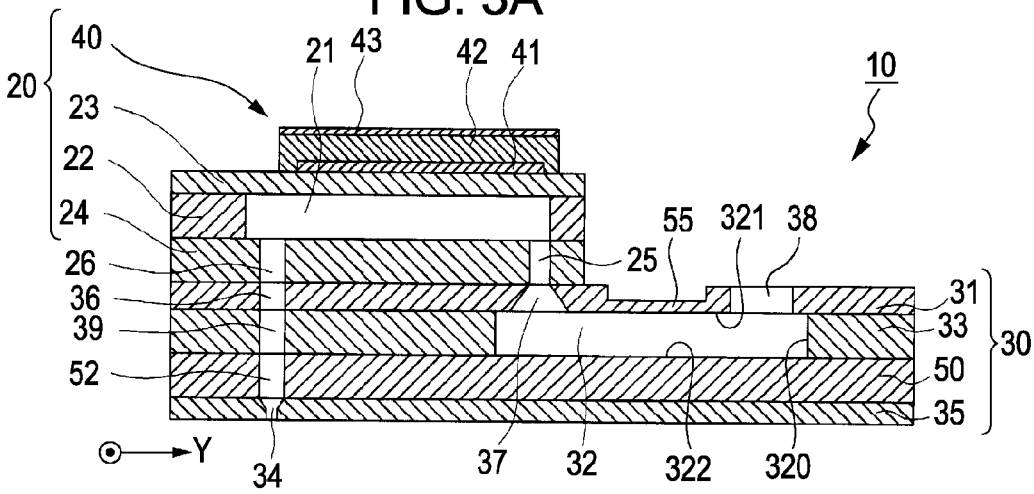
FIGS. 3A to 3C are cross-sectional views of the ink jet recording head.
Figure 3B:
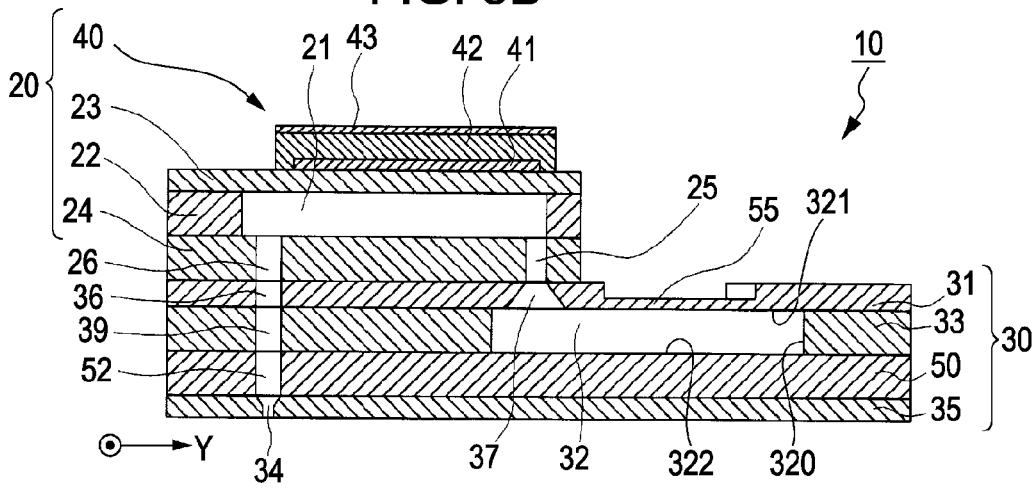
Figure 3C:
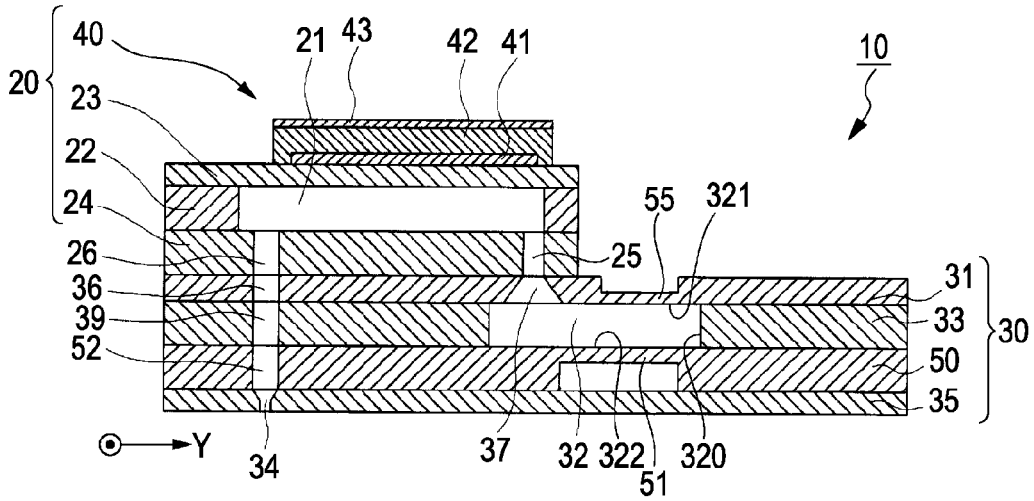

FIG. 2 is a plan view of a main part of the ink jet recording head 10. FIGS. 3A to 3C are cross-sectional views of the ink jet recording head 10 shown in FIG. 2, where FIG. 3A is a cross section taken along line IIIA-IIIA, FIG. 3B is a cross section taken along line IIIB-IIIB and FIG. 3C is a cross section taken along line IIIC-IIIC.

As shown in FIGS. 1 and 3A to 3C, the ink jet recording head 10 according to the present embodiment includes an actuator unit 20 and a flow channel unit 30 onto which the actuator unit 20 is fixed.

The actuator unit 20 is an actuator device with piezoelectric elements 40 formed thereon. The actuator unit 20 includes a flow channel-forming substrate 22, a vibrating plate 23 and a pressure generating chamber bottom plate 24. A pressure generating chamber 21 is formed in the flow channel-forming substrate 22. The vibrating plate 23 is provided at one side of the flow channel-forming substrate 22. The pressure generating chamber bottom plate 24 is provided at the other side of the flow channel-forming substrate 22.

A plurality of pressure generating chambers 21 are arranged in parallel in the flow channel-forming substrate 22. In FIGS. 1, 2, and 3A to 3C, the direction in which the pressure generating chambers 21 are arranged in parallel is defined as an X direction and the direction perpendicular to the X direction is defined as a Y direction. Each pressure generating chamber 21 is elongated in shape, extending in the Y direction.

The flow channel-forming substrate 22 is, for example, a ceramic plate such as one formed of alumina ($Al_2O_3$) or zirconia ($ZrO_2$) with a thickness of about 150 micrometers.

The vibrating plate 23 is, for example, a thin zirconia plate with a thickness of 10 micrometers. The vibrating plate 23 is fixed to one side of the flow channel-forming substrate 22 to define a surface of the pressure generating chambers 21. The pressure generating chamber bottom plate 24 is fixed to the other side of the flow channel-forming substrate 22 to form another surface of the pressure generating chambers 21.

The pressure generating chamber bottom plate 24 includes supply communication holes 25 and nozzle communication holes 26. The supply communication holes 25 are formed near one Y-direction end of the pressure generating chambers 21 for communication between the pressure generating chambers 21 and a reservoir 32 to be described later. The nozzle communication holes 26 are formed near the other Y-direction end of the pressure generating chambers 21 to enable communication between the pressure generating chambers 21 and nozzle orifices 34 to be described.

The piezoelectric elements 40 are provided on the vibrating plate 23 corresponding to each of the pressure generating chambers 21. The piezoelectric elements 40 each include a common lower electrode film 41 on the vibrating plate 23. A piezoelectric layer 42 is provided for each pressure generating chamber 21. An upper electrode film 43 is provided on each of the piezoelectric layers 42.

The piezoelectric layer 42 is formed by pasting or printing a piezoelectric green sheet. The lower electrode film 41 is provided across the parallelly-arranged piezoelectric layers 42 to form a common electrode for the piezoelectric elements 40. The lower electrode film 41 also functions as a part of the vibrating plate. Alternatively, the lower electrode film 41 may be provided for each piezoelectric layer 42.

The flow channel-forming substrate 22, the vibrating plate 23 and the pressure generating chamber bottom plate 24 altogether forming layers of the actuator unit 20 are formed of a clay-like ceramic material, also called a "green sheet". The green sheet is shaped to achieve a predetermined thickness. For example, the pressure generating chambers 21 are formed in the green sheet. The obtained layers are stacked and sintered to form an integrated unit without using an adhesive agent. The piezoelectric elements 40 are formed on the vibrating plate 23. In this manner, the actuator unit 20 is completed.

The flow channel unit 30 includes a liquid supply port-forming substrate 31, a reservoir-forming substrate 33, a compliance substrate 50 and a nozzle plate 35. The liquid supply port-forming substrate 31 is joined to the pressure generating chamber bottom plate 24 of the actuator unit 20. The reservoir-forming substrate 33 defines a side surface 320 of the reservoir 32, which is a common ink chamber for the pressure generating chambers 21. The compliance substrate 50 is provided at a side of the reservoir-forming substrate 33 opposite the liquid supply port-forming substrate 31. The nozzle plate 35 includes nozzle orifices 34 penetrating the same.

The liquid supply port-forming substrate 31 is a thin zirconia plate with a thickness of 150 micrometers, and has nozzle communication holes 36 and liquid supply ports 37 penetrating the same. The nozzle communication holes 36 connect the nozzle orifices 34 and the pressure generating chambers 21. The liquid supply ports 37 connect the reservoir 32 and the pressure generating chamber 21 together with the supply communication holes 25. The liquid supply port-forming substrate 31 also includes a liquid inlet port 38 which is in communication with the reservoir 32 to supply ink from an external ink tank, which is not illustrated.

The liquid supply ports 37 are formed at the side of the reservoir 32 in the Y direction to enable communication between the pressure generating chambers 21 and an end of the reservoir 32.

As shown in FIG. 2, the liquid inlet ports 38 are provided at a substantial X-direction center of the reservoir 32 and at a Y-direction end opposite the pressure generating chambers 21.

The reservoir-forming substrate 33 is formed of a material suitable for ink channels, e.g., a corrosion resistance plate material such as stainless steel with a thickness of 150 micrometers.

The reservoir-forming substrate 33 defines side surfaces 320 of the reservoir 32 and nozzle communication holes 39. The nozzle communication holes 39 connect the pressure generating chambers 21 and the nozzle orifices 34. The reservoir 32 receives ink from an external ink tank and supplies ink to the pressure generating chambers 21.

Hereinafter, the reservoir 32 will be described in detail with special reference to the configuration thereof.

As shown in FIGS. 1 and 3A to 3C, the side surfaces 320 of the reservoir 32 are defined by the reservoir-forming substrate 33, the upper surface 321 of the reservoir 32 is defined by the liquid supply port-forming substrate 31, and the lower surface 322 of the reservoir 32 is defined by the compliance substrate 50.

As shown in FIG. 2, the reservoir 32 includes a first area 32*a* and second areas 32*b* and 32*c*.

The first area 32*a* extends in both directions along the X direction of the pressure generating chamber 21 from the liquid inlet port 38 located in the substantial X-direction center of the reservoir 32. The Y-direction width of the first area 32*a* is substantially constant except for the area where the liquid inlet port 38 is formed.

The second areas 32*b* and 32*c* are located at both sides of the first area 32*a*. The Y-direction widths of the second areas 32*b* and 32*c* are smaller than that of the Y-direction width of the first area 32*a* and are tapered toward both ends of the reservoir 32. Such a configuration provides a constant flow rate of the ink supplied from the liquid inlet port 38.

As shown in FIGS. 1 and 3A to 3C, the compliance section which absorbs pressure fluctuation in the reservoir 32 is formed in the liquid supply port-forming substrate 31 and the compliance substrate 50.

The compliance section includes a first compliance section 55, and second compliance sections 51. The first compliance section 55 is formed in the liquid supply port-forming substrate 31 at the side of the upper surface 321 of the reservoir 32. The second compliance sections 51 are formed in the compliance substrate 50 at the side of the lower surface 322.

As shown in FIGS. 3A to 3C, the first compliance section 55 is formed as a thinned portion in the liquid supply port-forming substrate 31 at an area corresponding to the upper surface 321 of the reservoir 32.

As shown in FIG. 2, the configuration of the first compliance section 55 is formed in accordance with the configuration of the reservoir 32 when seen in plan view. In particular, a Y-direction width 1 in a central area 55*a* corresponding to the first area 32*a* of the reservoir 32 is narrower than the width of reservoir 32 and is constant except for the area where the liquid inlet port 38 is formed.

The first compliance section 55 also includes narrowed areas 55*b* and 55*c* corresponding both ends of the reservoir 32 in the X-direction. A Y-direction width $l_1$ gradually decreases toward both ends.

The second compliance sections 51 are formed in the compliance substrate 50 as thinned portions at areas where the compliance substrate 50 faces the reservoir 32.

In particular, the second compliance sections 51 are selectively formed only at areas corresponding to the second areas 32*b* and 32*c* at both ends of the reservoir 32. This configuration helps compensate for deficient compliance due to existence of the narrowed areas 55*b* and 55*c* of the first compliance section 55 in consideration that the compliance may become excessively large if the second compliance sections 51 are formed over the entire surface of the reservoir 32.

The second compliance sections 51 may slightly protrude from the areas corresponding to the second areas 32*b* and 32*c* of the reservoir 32 into the first area 32*a* of the reservoir 32.

Figure 4:
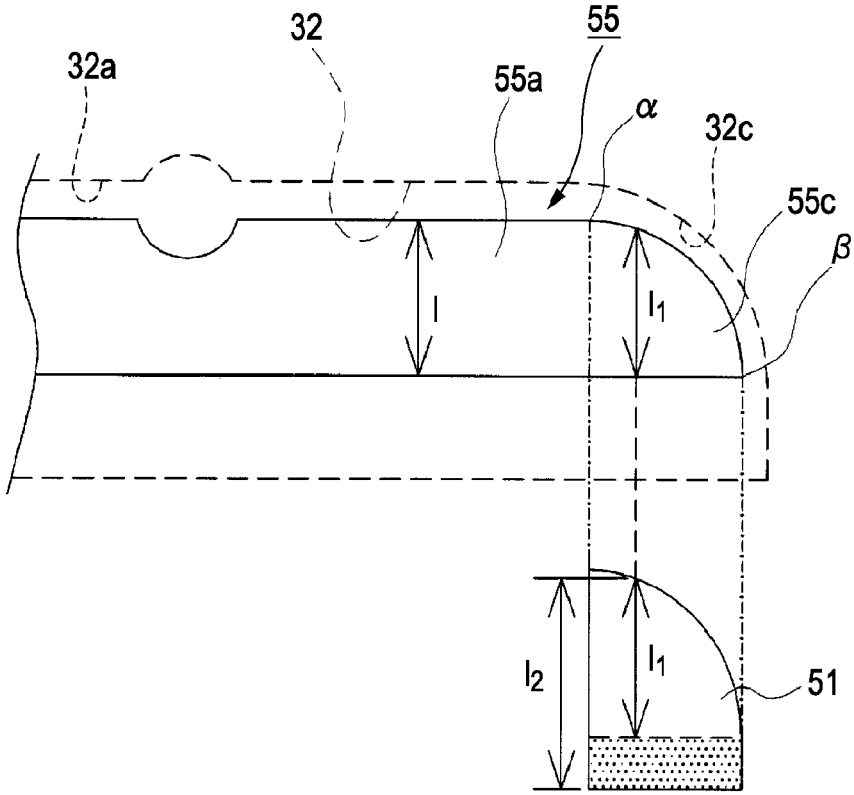
FIG. 4 schematically illustrates an exemplary positional relationship of compliance sections.

FIG. 4 is a schematic diagram showing a positional relationship between the first compliance section 55 and the second compliance section 51 according to the present embodiment (only the right half of a symmetric configuration is shown).

As shown in FIG. 4, a width of the second compliance section 51 corresponding to a narrowed area 55*c* of the first compliance section 55 which is an area between a point $\alpha$ and a point $\beta$ is larger than that of the narrowed area 55*c* in an area shown by the dotted line.

In particular, the width $l_2$ of the second compliance section 51 is larger than the width $l_1$ of the first compliance section 55 at the same position.

It is known that compliance is proportional to the fourth power of the width of the compliance section. Accordingly, it suffices that the compliance satisfies $l^4 < l_1^4 + l_2^4$ in order to compensate for the deficient compliance at both ends. A summed amount of the compliance in the narrowed areas 55*b* and 55*c* may become slightly large. However, when the compliance becomes excessively large, the areas resonate with the pressure wave from the pressure generating chamber due to characteristic frequency. As a result, operation of the ink jet recording head may become unstable.

The first compliance section 55 may be formed at a lower surface 322 side of the reservoir 32 and the second compliance section 51 may be formed at an upper surface 321 side of the reservoir 32. In the present embodiment, the liquid supply port 37 is formed in the liquid supply port-forming substrate 31 at the side of the upper surface 321. The area where the first compliance section 55 is formed is restricted by the position of the liquid supply port 37. Accordingly, the degree of freedom in selecting areas for providing the first compliance section 55 decreases. Therefore, the deficient compliance can be easily adjusted if the width of the second compliance section 51 is large at the side of the lower surface 322*c*.

The compliance substrate 50 may be formed of a metal material such as stainless steel or a ceramic material. Note that the compliance substrate 50 is not limited to those described above and may alternatively be configured by a film-like elastic membrane constituting the second compliance section 51, and a support substrate which is partly penetrated in the thickness direction.

As shown in FIGS. 1 and 3A to 3C, the compliance substrate 50 includes a nozzle communication hole 52 provided to penetrate the compliance substrate 50 in the thickness direction. The nozzle communication hole 52 connects the nozzle communication hole 39 provided in the reservoir-forming substrate 33 and the nozzle orifice 34.

The ink in the pressure generating chamber 21 is discharged from the nozzle orifice 34 via nozzle communication holes 36, 39 and 52 provided in the liquid supply port-forming substrate 31, the reservoir-forming substrate 33 and the compliance substrate 50.

The nozzle plate 35 is, for example, a thin stainless steel plate with nozzle orifices 34 arranged at the same pitches as those of the pressure generating chambers 21.

The flow channel unit 30 is configured by a liquid supply port-forming substrate 31, a reservoir-forming substrate 33, a compliance substrate 50 and a nozzle plate 35 which are fixed together with an adhesive agent or a thermally fusible film. The flow channel unit 30 and the actuator unit 20 are joined and fixed via an adhesive agent and a thermally fusible film.

In the ink jet recording head 10 according to the present embodiment, the ink is supplied from the ink tank to the reservoir 32 via the liquid inlet port 38. The ink channel from the reservoir 32 to the nozzle orifice 34 is filled with ink.

Then, according to recording signals from an unillustrated drive circuit, voltage is applied to each piezoelectric element 40 corresponding to each pressure generating chamber 21 so as to deform the piezoelectric element 40 together with the vibrating plate 23. In this manner, pressure in each pressure generating chamber 21 increases to discharge an ink droplet from each nozzle orifice 34.

The present embodiment has the following advantageous effects.

(1) The deficient compliance in the narrowed areas 55*b* and 55*c* of the first compliance section 55 corresponding to the narrowed second areas 32*b* and 32*c* of the reservoir 32 is compensated for by the compliance of the second compliance section 51. Thus, vibration due to the pressure wave propagated from the pressure generating chamber 21 can be controlled in the reservoir 32 more effectively. Accordingly, an ink jet recording head 10 in which variation in ink jet characteristics resulting from, for example, variation in droplet ejection rate is controlled can be obtained.

(2) The deficient compliance at the narrowed width $l_1$ of the first compliance section 55 is sufficiently compensated for by the compliance of the second compliance section 51 with the width $l_2$ larger than the width $l_1$. Thus, vibration due to the pressure wave propagated from the pressure generating chamber 21 can be controlled in the reservoir 32 more effectively. Accordingly, an ink jet recording head 10 in which variation in ink jet characteristics resulting from, for example, variation in droplet ejection rate is controlled can be obtained.

Modified Embodiment

Figure 5:
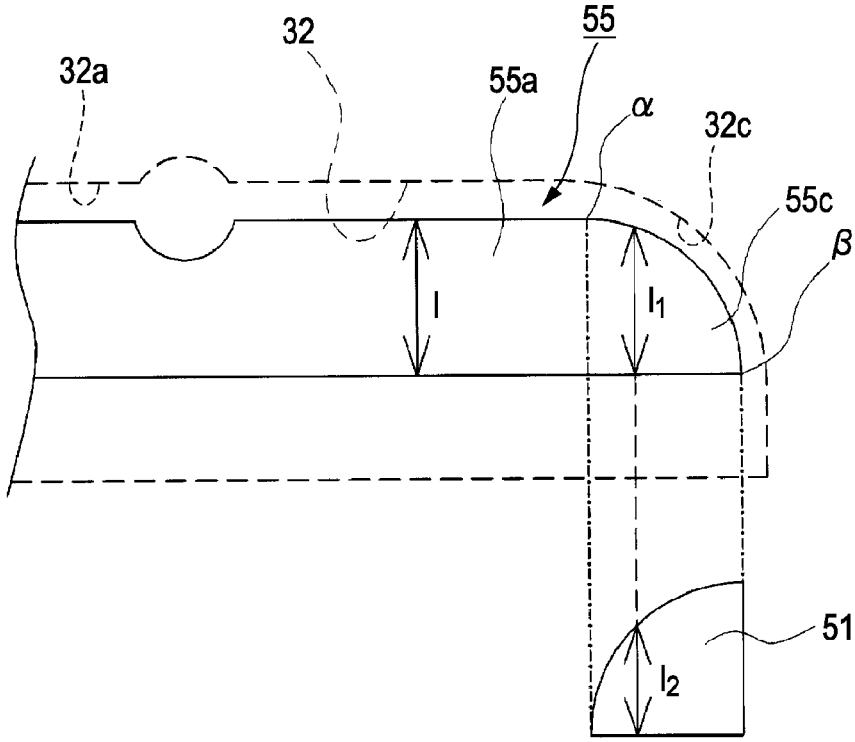
FIG. 5 schematically illustrates an exemplary positional relationship of compliance sections according to a modified embodiment of the invention.

FIG. 5 is a schematic diagram showing a positional relationship between the first compliance section 55 and the second compliance section 51 according to a modified embodiment of the invention (only right half of a symmetric configuration is shown).

In the modified embodiment shown in FIG. 5, the second compliance section 51 is formed such that $l^4 \approx l_1^4 + l_2^4$, in which a width at an arbitrary position in the narrowed area 55*c* of the first compliance section 55 which is an area between a point $\alpha$ and a point $\beta$ is $l_1$, and a width of the second compliance section 51 at a position corresponding to the arbitrary position is $l_2$.

The present embodiment has the following advantageous effects.

(3) The second compliance section 51 compensates for the deficient compliance at the narrowed areas 55*b* and 55*c* of the first compliance section 55 ideally and in a just enough manner. The width $l_2$ of the second compliance section 51 is determined to compensate for the deficient compliance in accordance with the width $l_1$ of the first compliance section 55. Accordingly, the compliance can be constant in the second areas 32*b* and 32*c* of the reservoir 32. Thus, the energy of the pressure wave is absorbed in a constant amount and vibration due to the pressure wave propagated from the pressure generating chamber 21 can be controlled in the reservoir 32 more effectively.

Second Embodiment

Figure 6:
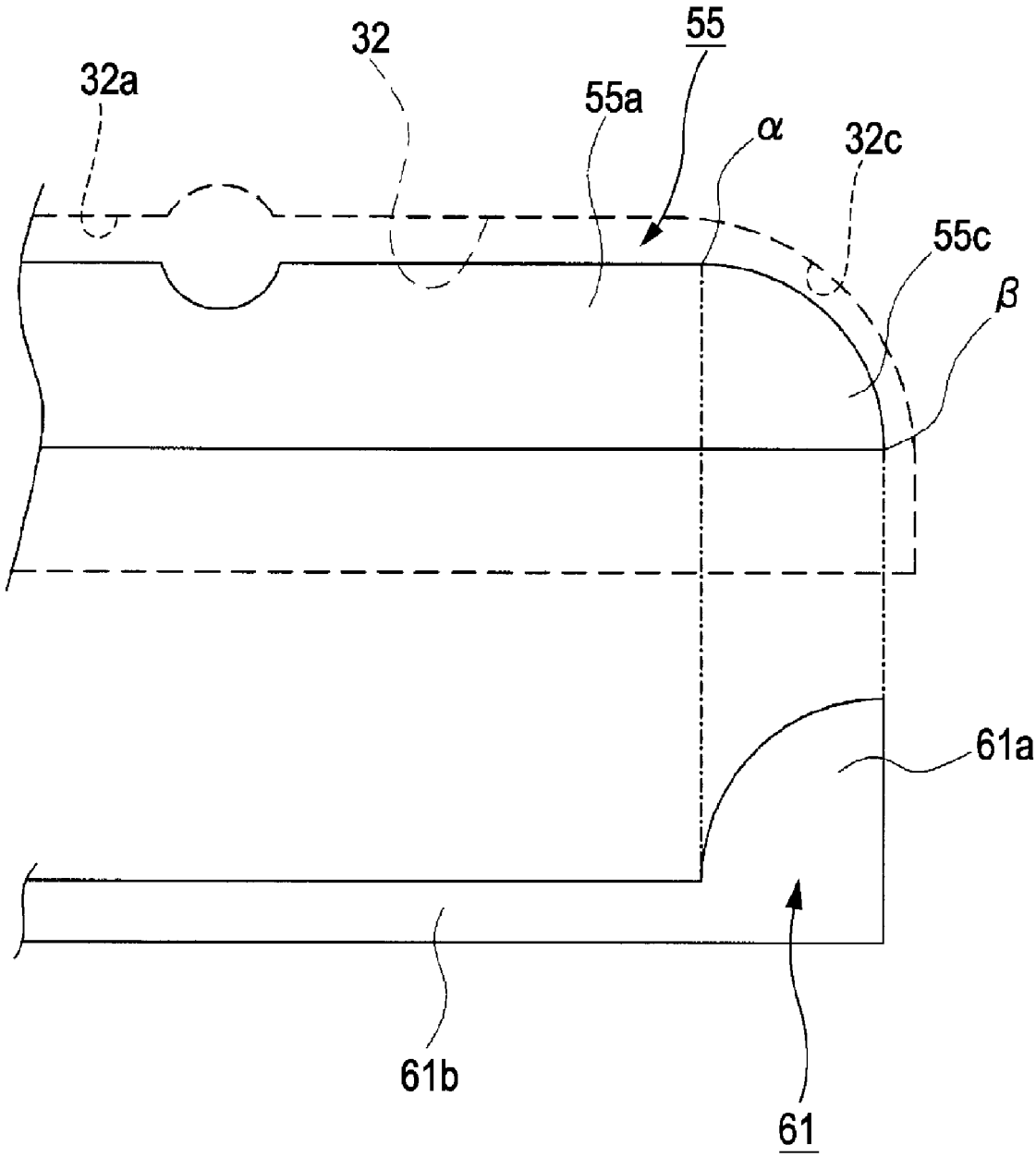
FIG. 6 schematically illustrates an exemplary positional relationship of compliance sections according to a second embodiment of the invention.

FIG. 6 is a schematic diagram showing a positional relationship between the first compliance section 55 and a second compliance section 61 according to a second embodiment. Other configurations are similar to those of the modified embodiment.

In FIG. 6, both ends 61*a* of a second compliance section 61 disposed opposite the first compliance section 55 are formed in accordance with the second compliance section 51 of the modified embodiment. A narrowed compliance section 61*b* integrally continued from both ends 61*a* is formed between the points $\alpha$ (only one of them is shown in the drawing).

The present embodiment has the following advantageous effects.

(4) Even if width l and width $l_1$ of the first compliance section 55 are formed equal to or narrower than that of the reservoir, the deficient compliance is easily and effectively compensated for by the second compliance section 61. Thus, vibration due to the pressure wave propagated from the pressure generating chamber 21 can be controlled in the reservoir 32 more effectively. Accordingly, an ink jet recording head 10 in which variation in ink jet characteristics resulting from, for example, variation in droplet ejection rate is controlled can be obtained.

Third Embodiment

The ink jet recording head 10 according to the first, second or modified embodiment constitutes a part of recording head units 1A and 1B and is mounted on an ink jet recording apparatus I.

The recording head units 1A and 1B each includes an ink channel which is in communication with a cartridge serving as an ink tank.

Figure 7:
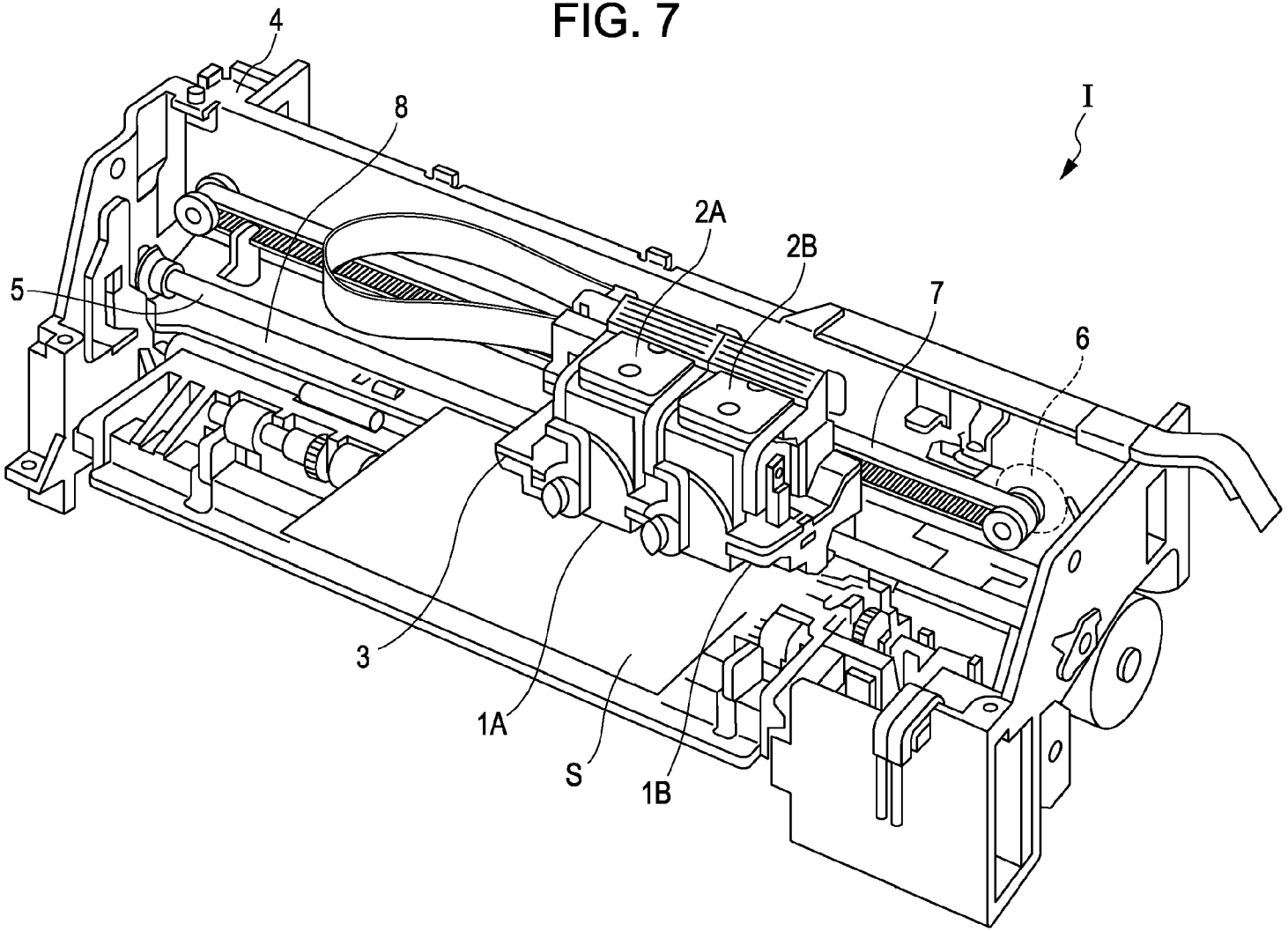
FIG. 7 schematically illustrates an exemplary ink jet recording apparatus according to an embodiment and a modified embodiment of the invention.

FIG. 7 schematically illustrates an exemplary ink jet recording apparatus I.

As shown in FIG. 7, cartridges 2A and 2B which constitute an ink supply unit are removably attached to the recording head units 1A and 1B in the ink jet recording apparatus I. The recording head units 1A and 1B are mounted to a carriage 3. The carriage 3 is attached to a carriage shaft 5 in a device body 4 so as to be movable in an axial direction. The recording head unit 1A discharges black ink composition and recording head unit 1B discharge color ink composition, for example.

The carriage 3 travels along the carriage shaft 5 with the recording head units 1A and 1B mounted thereon due to driving force from a drive motor 6 transmitted via unillustrated plural gears and a timing belt 7.

A platen 8 is provided in the device body 4 along the carriage shaft 5. Recording sheet S, which is a recording media such as a sheet of paper fed by an unillustrated paper feed roller and other members is transported around the platen 8.

The present embodiment has the following advantageous effects.

(5) Ink jet characteristics is improved and uniformized to provide a liquid ejecting apparatus with improved print quality.

In addition to the described embodiments and modified embodiments, various modifications can be made. In the first embodiment, the second compliance section 51 is formed in the compliance substrate 50 between the reservoir-forming substrate 33 and the nozzle plate 35. The compliance section, however, may be formed as a thinned portion in the nozzle plate 35. The configuration of the thinned portion is similar to that of the second compliance section 51.

A thinned portion formed in the nozzle plate 35 may adversely affect the vibration of the nozzle plate 35. In this case, however, it suffices that the compliance section is formed at limited areas corresponding to the second areas 32*b* and 32*c* of the reservoir 32. It is thus considered that the adverse effects of the second compliance section 51 on the vibration of the nozzle plate 35 are not significant.

Alternatively, the first compliance section 55 may be formed in the compliance substrate 50 and the second compliance section 51 may be formed in the liquid supply port-forming substrate 31. In this case, since the size of the first compliance section 55 can be increased as compared with the embodiments and the modified embodiments described above, compliance is reliably obtained even if the entire ink jet recording head 10 is made compact.

The reservoir 32 does not necessarily have a narrowed area near the liquid inlet port 38 in the middle of the reservoir 32 as in the first embodiment. The second compliance section 51 may alternatively be provided in accordance with the narrowed area of the first compliance section 55 near the liquid inlet port 38.

Figure 8:
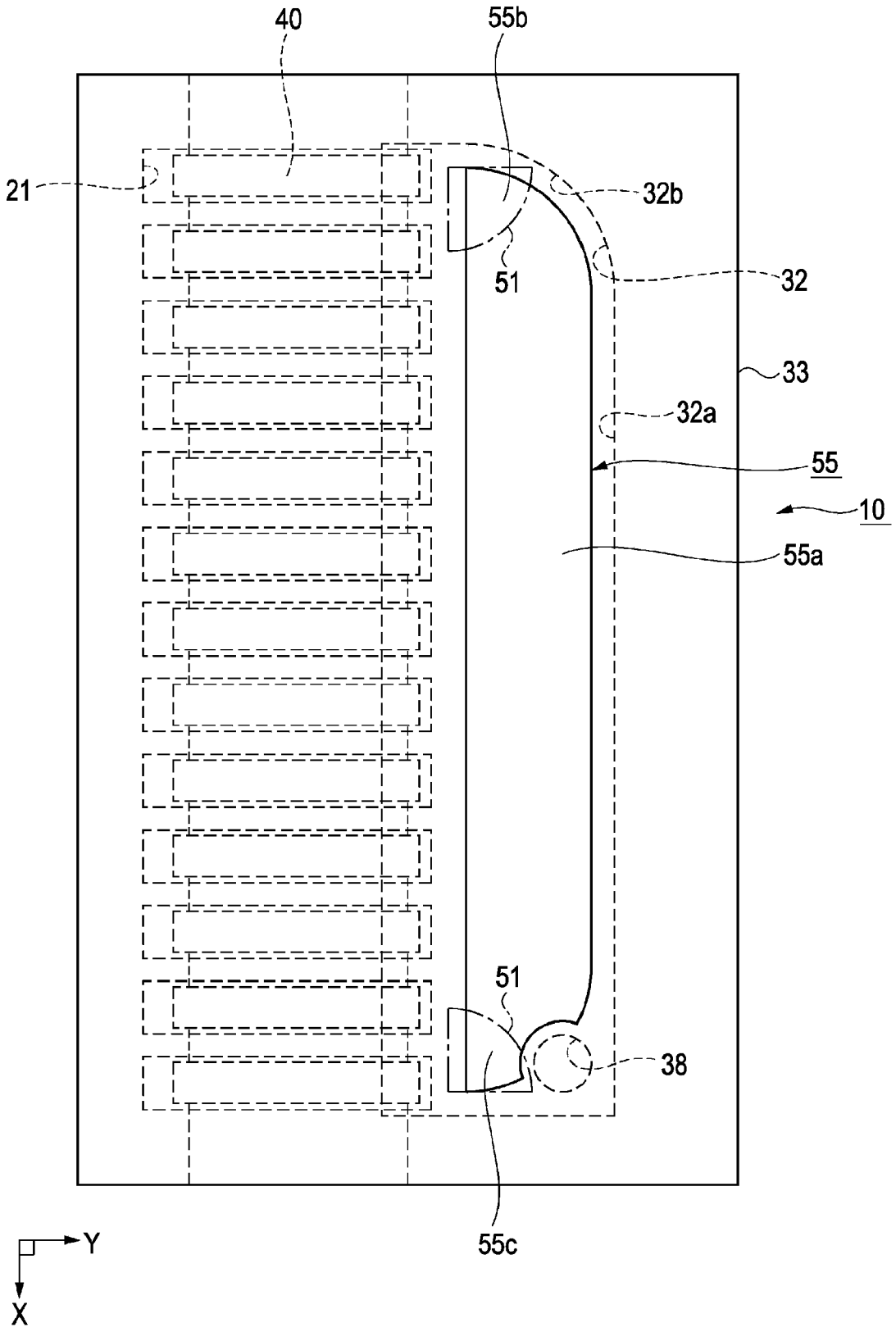
FIG. 8 schematically illustrates an exemplary positional relationship of the compliance sections.
Figure 9:
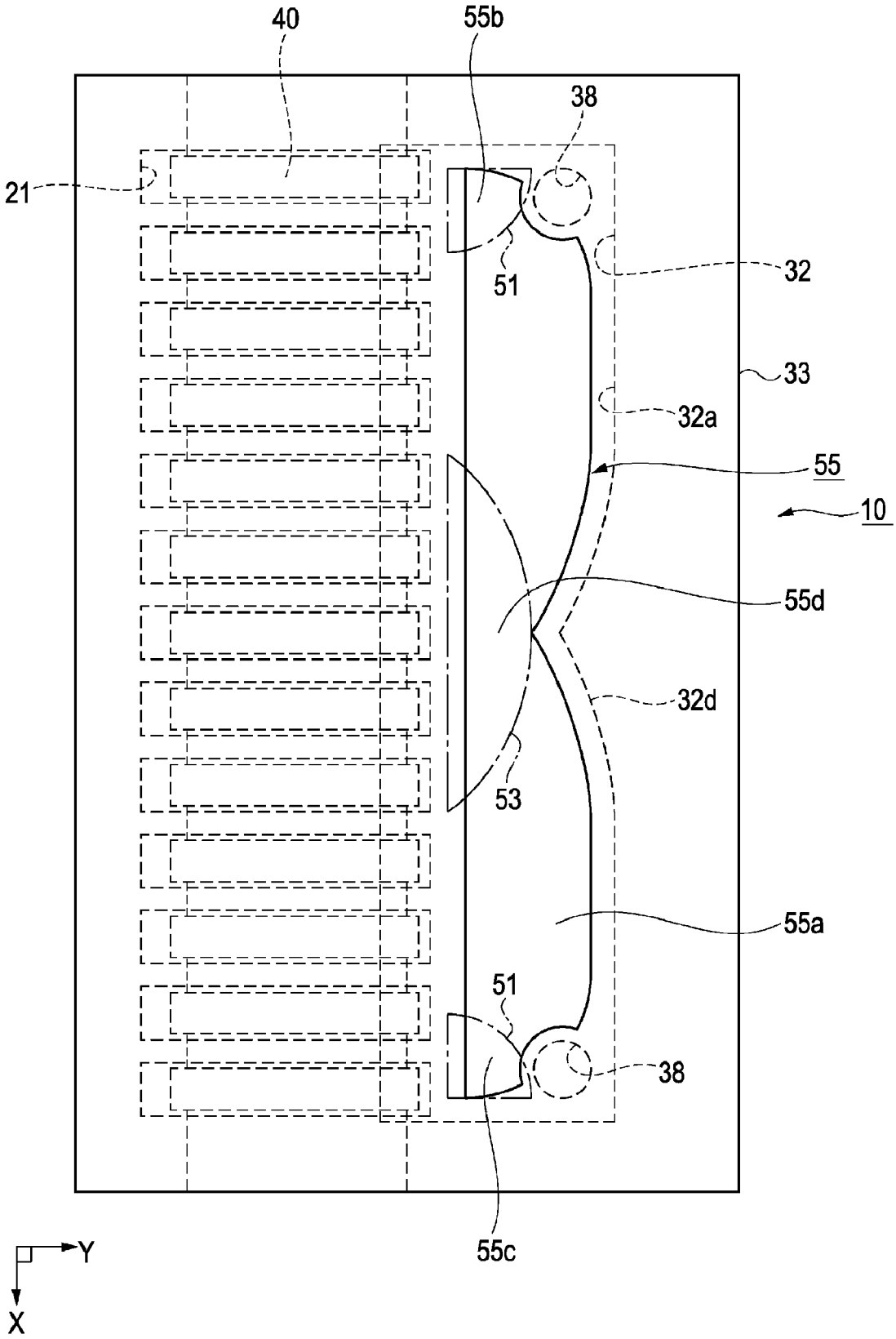
FIG. 9 schematically illustrates an exemplary positional relationship of the compliance sections.

The position of the liquid inlet port 38 and the configuration of the reservoir 32 are not limited to those described above. For example, as shown in FIGS. 8 and 9, the liquid inlet port 38 may be provided at an end of the reservoir 32. Two liquid inlet ports 38 may alternatively be provided at both ends of the reservoir 32. Even in this case, vibration can be controlled effectively by the first and second compliance sections 55, 51 and 53. Alternatively, three or more liquid inlet ports 38 may also be provided.

Also in this case, if there is a narrowed area in the first compliance section 55, the second compliance section 51 can be provided corresponding to that area.

As shown in FIG. 8, the reservoir 32 includes a second area 32*b*, the first compliance section 55 includes a narrowed area 55*b* corresponding to the second area 32*b* and a narrowed area 55*c* provided near the liquid inlet port. The second compliance section 51 is formed corresponding to the narrowed areas 55*b* and 55*c*.

As shown in FIG. 9, the reservoir 32 includes a second area 32*d*, the first compliance section 55 includes a narrowed area 55*b* corresponding to the second area 32*d* and a narrowed area 55*d* provided near the liquid inlet port. The second compliance sections 51 and 53 are formed corresponding to the narrowed areas 55*b*, 55*c* and 55*d*.

In the embodiments and modified embodiments described above, the ink jet recording head 10 with a thick-film piezoelectric element 40 has been illustrated. However, the pressure generating unit for generating pressure fluctuation in the pressure generating chamber 21 is not limited to those described. For example, an ink jet recording head with the following pressure generating unit may have the same effects as those described: a thin-film piezoelectric element with a piezoelectric material formed by a sol-gel method, a MOD method, a sputtering process and other methods; a longitudinal oscillation piezoelectric element configured by piezoelectric materials and electrode formation materials stacked alternately and then stretched in an axial direction; a so-called electrostatic actuator in which a vibrating plate and an electrode are placed with a predetermined gap formed therebetween so as to control vibration of the vibrating plate by static electricity; and a device in which a heater element is disposed in the pressure generating chamber and a droplet is discharged from a nozzle orifice due to babbles generated by the heat of the heater element.

In the embodiments and modified embodiments, the ink jet recording head have been illustrated as an exemplary liquid ejecting head. The invention, however, may be applied to various liquid ejecting heads. The invention can thus be applied to a method of inspecting a liquid ejecting head which injects liquids other than ink. Other liquid ejecting heads may include various recording heads used for image recorders such as a printer, a color material injection head used in production of a color filter such as a liquid crystal display, an electrode material injection head used for formation of electrodes in an organic EL display, a field emission display (FED) or other displays, and a biological body organic matter injection head used in production of biochips.

The entire disclosure of Japanese Patent Application No. 2008-038384, filed Feb. 20, 2008 is incorporated by reference herein.

The entire disclosure of Japanese Patent Application No. 2008-286217, filed Nov. 7, 2008 is incorporated by reference herein.

What is claimed is:

1. A liquid ejecting head, comprising:

a plurality of parallelly-arranged pressure generating chambers each discharging a liquid through a nozzle orifice by pressure fluctuation;

a plurality of pressure generating elements which each generate a pressure fluctuation in the corresponding pressure generating chamber;

a reservoir provided along a direction in which the plurality of pressure generating chambers are parallelly-arranged for supplying a liquid to the pressure generating chambers, the reservoir including a first area and a second area of a width smaller than that of the first area in a direction perpendicular to the direction in which the pressure generating chambers are parallelly-arranged; and a compliance member provided in an area corresponding to the reservoir for absorbing pressure fluctuation in the reservoir, wherein:

the compliance member includes a first compliance section formed at the upper surface side of the reservoir and a second compliance section formed at the lower surface side of the reservoir, wherein the first compliance section is part of a liquid supply port-forming substrate and has a smaller width than the other portions of the liquid supply port-forming substrate; and the first compliance section is formed at an area corresponding to both the first area and the second area of the reservoir, and the second compliance section is not formed in at least an area corresponding to a part of the first area.

2. A liquid ejecting head according to claim 1, wherein a width of a section of the first compliance section is smaller than the width of a section of the second compliance section.

3. A liquid ejecting head according to claim 1, wherein the width of the reservoir is larger than the width of the first compliance section at a corresponding area.

4. A liquid ejecting head according to according to claim 1, wherein the first compliance section and the second compliance section are formed so that a width $l_1^4$+a width $l_2^4$ is constant when the width $l_1$ is the width of the first compliance section and the width $l_2$ is the width of the second compliance section.

5. A liquid ejecting apparatus comprising:

a liquid ejecting head, that includes:

a plurality of parallelly-arranged pressure generating chambers each discharging a liquid through a nozzle orifice by pressure fluctuation;

a plurality of pressure generating elements which each generate a pressure fluctuation in the corresponding pressure generating chamber;

a reservoir provided along a direction in which the plurality of pressure generating chambers are parallelly-arranged for supplying a liquid to the pressure generating chambers, the reservoir including a first area and a second area of a width smaller than that of the first area in a direction perpendicular to the direction in which the pressure generating chambers are parallelly-arranged; and a compliance member provided in an area corresponding to the reservoir for absorbing pressure fluctuation in the reservoir, wherein:

the compliance member includes a first compliance section formed at the upper surface side of the reservoir and a second compliance section formed at the lower surface side of the reservoir, wherein the first compliance section is part of a liquid supply port-forming substrate and has a smaller width than the other portions of the liquid supply port-forming substrate; and the first compliance section is formed at an area corresponding to both the first area and the second area of the reservoir, and the second compliance section is not formed in at least an area corresponding to a part of the first area.

6. A liquid ejecting apparatus according to claim 5, wherein a width of a section of the first compliance section is smaller than the width of a section of the second compliance section.

7. A liquid ejecting apparatus according to claim 5, wherein the width of the reservoir is larger than the width of the first compliance section at a corresponding area.

8. A liquid ejecting apparatus according to according to claim 1, wherein the first compliance section and the second compliance section are formed so that a width $l_1^4$+a width $l_2^4$ is constant when the width $l_1$ is the width of the first compliance section and the width $l_2$ is the width of the second compliance section.

* * * * *